United States Patent [19]

Nakade et al.

[11] Patent Number: 4,821,070

[45] Date of Patent: Apr. 11, 1989

[54] DISPLAY FOR IMAGE FORMING APPARATUS

[75] Inventors: Toshiyuki Nakade, Settsu; Tsugio Nakanishi, Osaka; Toshinori Muraoka, Osaka; Noboru Fukuoka, Osaka; Tsuyoshi Nagao, Sakai; Hideki Endoo, Osaka; Kazuyoshi Yamamura, Sakai; Yoshio Sugishima, Osaka; Katuhide Yamaguchi, Takatsuki, all of Japan

[73] Assignee: Mita Industrial Co., Ltd., Osaka, Japan

[21] Appl. No.: 125,200

[22] Filed: Nov. 25, 1987

[30] Foreign Application Priority Data

Nov. 29, 1986 [JP] Japan ..... 61-184538[U]
Nov. 29, 1986 [JP] Japan ..... 61-184539[U]

[51] Int. Cl.[4] ..... G03G 15/00

[52] U.S. Cl. ..... 355/14 R; 355/3 SH; 355/14 SH; 355/14 CU

[58] Field of Search ..... 355/3 R, 3 SH, 14 R, 355/14 SH, 14 CU, 14 C

[56] References Cited

U.S. PATENT DOCUMENTS

| | | | |
|---|---|---|---|
| 4,383,756 | 5/1983 | Hanamoto et al. | 355/14 CU |
| 4,417,350 | 11/1983 | Ito et al. | 355/14 CU X |
| 4,470,692 | 9/1984 | Shimizu et al. | 355/14 R |
| 4,589,765 | 5/1986 | Perun et al. | 355/14 R X |
| 4,615,609 | 10/1986 | Honma | 355/14 R |
| 4,615,610 | 10/1986 | Yoshiura | 355/14 R |

*Primary Examiner*—A. C. Prescott
*Attorney, Agent, or Firm*—Koda and Androlia

[57] ABSTRACT

The present invention relates to a display for image forming apparatus to enable indication of the number of processing sheets and also indication of impossible paper feeding on the paper feed pass on one display by time-sharing at different times, and particularly concerning the point that indication of disabled paper feeding and indication of the above mentioned number of processing sheets are made alternatively when the indication of disabled paper feeding is given by providing a paper sensing switch in the paper supplying mechanism.

3 Claims, 5 Drawing Sheets

DISPLAY FOR IMAGE FORMING APPARATUS

BACKGROUND OF THE INVENTION

1. Field of the Invention

The present invention relates to a display for image forming apparatus of copying machines, laser beam printers and others which is so contrived that the number of processing sheets such as copy and disabled paper feeding by the paper feed system can be indicated commonly on one display.

2. Description of the Prior Art

The image forming apparatus of conventional copying machines and laser beam printers are provided with a paper sensing switch to check whether or not the paper to be supplied is set in the cassette or on the manual paper supplying mechanism as an example of the means to find if paper feeding on the paper feeding pass is possible or not.

Such apparatus are so composed that a display for dedicated use which is provided in the operation unit indicates no paper when the paper sensing switch detects no paper passing. While the number of processing sheets such as copy is set by the operator prior to the copying operation.

The indication of the above mentioned number of processing sheet is also given on an independent display for dedicated use, and the number of processing sheets is indicated separately from the indication of disabled paper feeding due to no passing paper.

As described above, however, it is uneconomical to provide a display to indicate disabled paper feeding separately from the display to indicate the number of processing sheets like preset number of sheets to be copied or the number of remaining sheets left to be copied further.

Accordingly, the display of the copying machine stated in the Official Gazette of U.S. Pat. No. 4,470,692 for example, is so composed to indicate both the preset number of sheets to be copied (number of processing sheets) and other indications (such as no paper to be copied) commonly on one display.

The display of the copying machine shown in the Official Gazette of U.S. Pat. No. 4,470,692 is advantageous in that the number of display units can be decreased. However, the display has a problem in that the number of sheets to be copied (the number of processing sheets) can not be confirmed until the processing like setting copy paper into the cassette is completed because the display is so composed that display concerning the number of sheet to be copied is not given while indication of no paper, for example, is given.

Accordingly, the trouble is that the rule-of-thumb guide for the number of sheets to be supplied is unknown to the operator in such a case when he realizes that the machine has been stopped and tries to supply paper. In addition, the display of the copying machine shown in the Official Gazette of U.S. Pat. No. 4,470,692 is disadvantageous in that the cost becomes higher by the number of the required switch for sensing copy paper although it is advantageous in that the number of units of display can be decreased as mentioned above.

SUMMARY OF THE INVENTION

In view of the foregoing, the primary object of the present invention is to make operators easier to confirm how many more number of sheets should be supplied when the copying machine stops because the paper in the cassette, for example runs out.

Another object of the present invention is to eliminate the copy paper sensing switch in the paper supplying mechanism in order to reduce the cost.

The present invention relates to a display for image forming apparatus to enable indication of the number of processing sheets and also indication of impossible paper feeding on the paper feed pass on one display by time-sharing at different times, and particularly concerning the point that indication of disabled paper feeding and indication of the above mentioned number of processing sheets are made alternatively when the indication of disabled paper feeding is given by providing a paper sensing switch in the paper supplying mechanism.

Accordingly, when the paper sensing switch provided in the paper supplying mechanism detects disabled of paper feeding due to no paper in the paper supplying mechanism, for example, the indication of disabled paper feeding and the indication of the number of processing sheets flash alternatively according to the signals from the paper sensing switch.

By above flashing indications, the operator can obtain both inforamtion on one display at one time that paper jamming, for example, is not the cause of stopping machine and that the machine can be started again by simply supplying paper and also that how many sheets should be supplied, which serves to rationalize the work and to make the efficiency higher.

And if the paper sensing switch in the paper supplying mechanism is eliminated and an arrangement is made so that paper feeding abled or disabled is judged, by a paper feed sensing swtich provided in the paper supplying mechanism, for example, the display repeats indication of disabled paper feeding and of the number of processing sheets alternatively if misfeeding of paper in the paper supplying mechanism or paper jamming occurs, or there is no paper to be supplied. By these indications, the operator can see at a glance how many sheets should be supplied and also that the trouble is related to the paper supplying mechanism. Accordingly, causes of troubles can be found easily only by checking if any paper is left or not in the cassette or on the manual paper supplying tray, and the image forming apparatus can be started again.

DETAILED DESCRIPTION OF PREFERRED EMBODIMENTS

Figure 3:
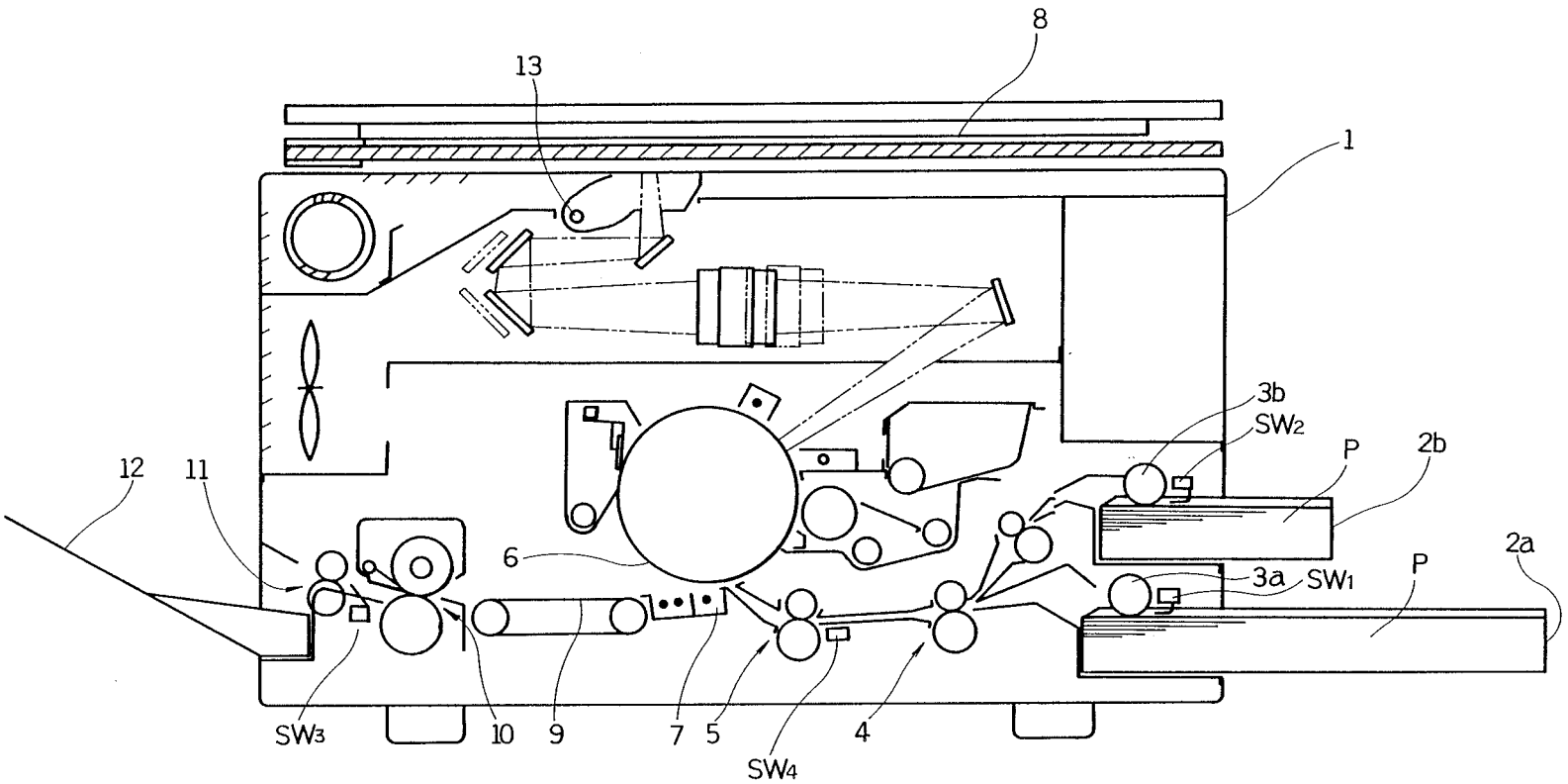
FIG. 3 is a schematic structural drawing to explain the internal structure of a copying machine incorporating same display.

Referring now to FIG. 3, a copying machine is outlined first as the background of the present invention. In this embodiment, two cassettes 2*a* and 2*b* are mounted onto the body of the copying machine 1 as the paper supplying mechanism. However, this invention is also applicable to copying machines provided with more number of cassettes or manual paper supplying mechanism. Copy paper sensing switches SW1 and SW2 to check whether or not the copy paper P is set inside are attached respectively to the cassette 2*a* and 2*b*.

The copy paper P sent out from the cassette 2*a* or 2*b* by a paper feed roller 3*a* or 3*b* goes through the feed roller 4 and the resist roller 5, and while the copy paper goes between the photo-sensitive drum 6 and the transfer charger 7, the toner image corresponding to the image of the document which is put on the document table 8 on the body of the copying machine 1 is transferred. The copy paper P onto which the toner image is transferred goes to the fixing mechanism 10 being carried on the transfer belt 9, where the toner image is fixed on the paper then is discharged from the paper discharge roller 11 to the paper discharge tray 12.

The light source 13 exposes and scans the document put on the document table 8 and forms the document image on the surface of the above mentioned photo-sensitive drum 6.

A paper feed sensing switch SW4 to detect the copy paper inserted into the resist roller 5 is provided before the resist roller 5.

Figure 1:
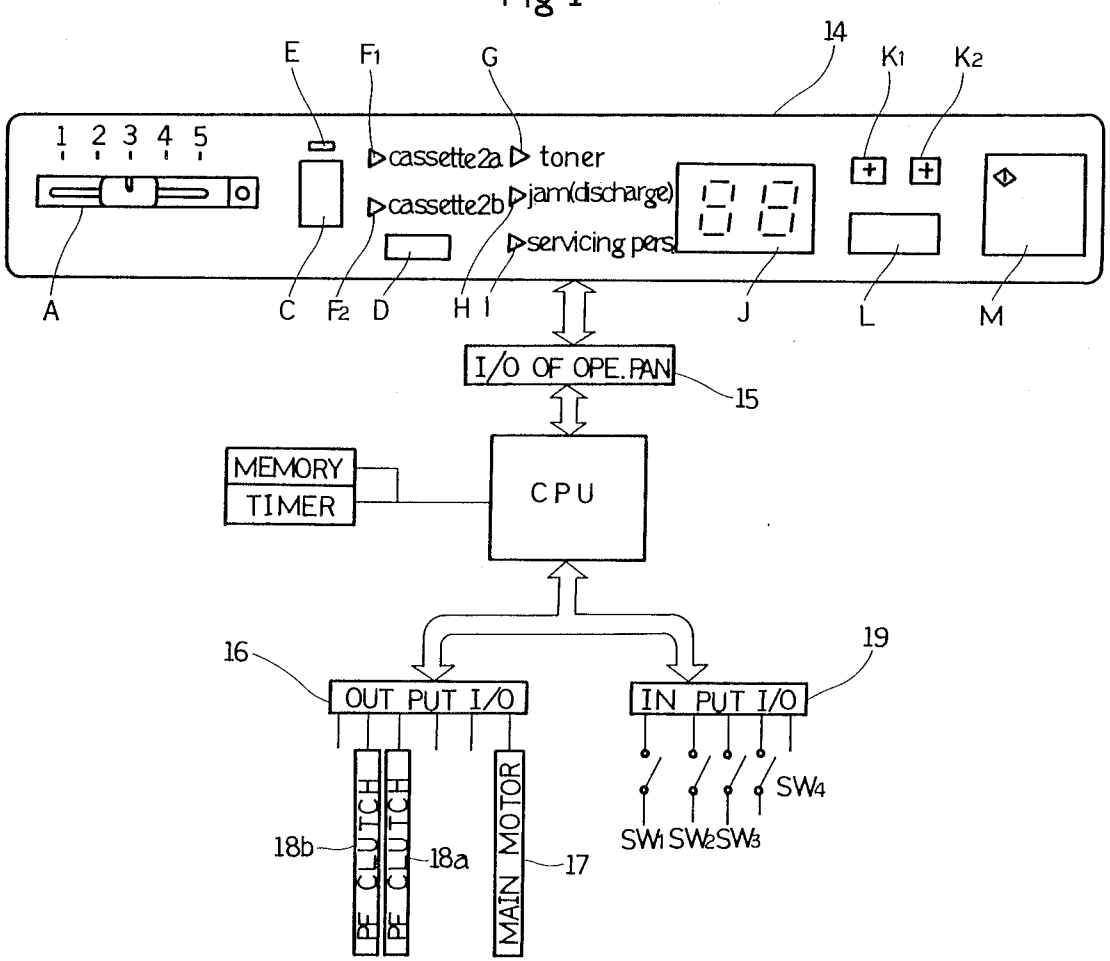
FIG. 1 is a block diagram to show signal flow through the display of an embodiment of a copying machine to which the present invention is applied.

An operation panel 14 as shown in FIG. 1 is provided on the body of copying machine 1 as described above. A brief description of each operating unit and the display unit on the operation panel 14 appears in the following text.

A slide switch A used for setting image density, an automatic density switch C which automatically changes and adjusts density, an LED for automatic density adjustment E which glows under automatic density adjustment mode, a paper feed change-over switch D to select a cassette to be used, 2*a* or 2*b*, an LED F1 to indicate that the cassette 2*a* is in use, an LED F2 to indicate that the cassette 2*b* is in use, an LED G to indicate that toner must be supplied, an LED H which glows when the jam sensing switch SW3 which is provided between the fixing mechanism 10 and the paper discharge roller 11 shown in the above FIG. 3 detects paper jam, an LED I which glows to call a servicing personnel when a trouble which is not suitable to be repaired by the user happens, a display J of segment type as the main factor of this embodiment which is commonly used to indicate no copy paper in the paper supplying mechanism and also the number of sheets to be copied, the push-button switches K1, K2 to change numerical figures at the tenth digit and the unit digit of the above mentioned segment type indicator J of two places, a push-button switch L used commonly for both clearing preset mode and for emergency stop, and a copy button M are provided in the operation panel 14.

Each operation element or the display on the above mentioned operation panel 14 is connected to a central processing unit C.P.U. intermediated by the I/O port 15 of the operation mechanism, and to the C.P.U., the main motor 17 and the paper feed clutches 18*a*, 18*b* which are used to control transfer of the rotary force from the main motor 7 to the paper feed rollers 3*a* and 3*b* shown in abofe mentioned FIG. 3 are connected respectively intermediated by the I/O port 16 of the output side, and the above mentioned copy paper sensing switches SW1, SW2, the jam sensing switch SW3, and the paper feed sensing switch SW4 are also connected respectively through the I/O port 19 of the input side.

Figure 2:
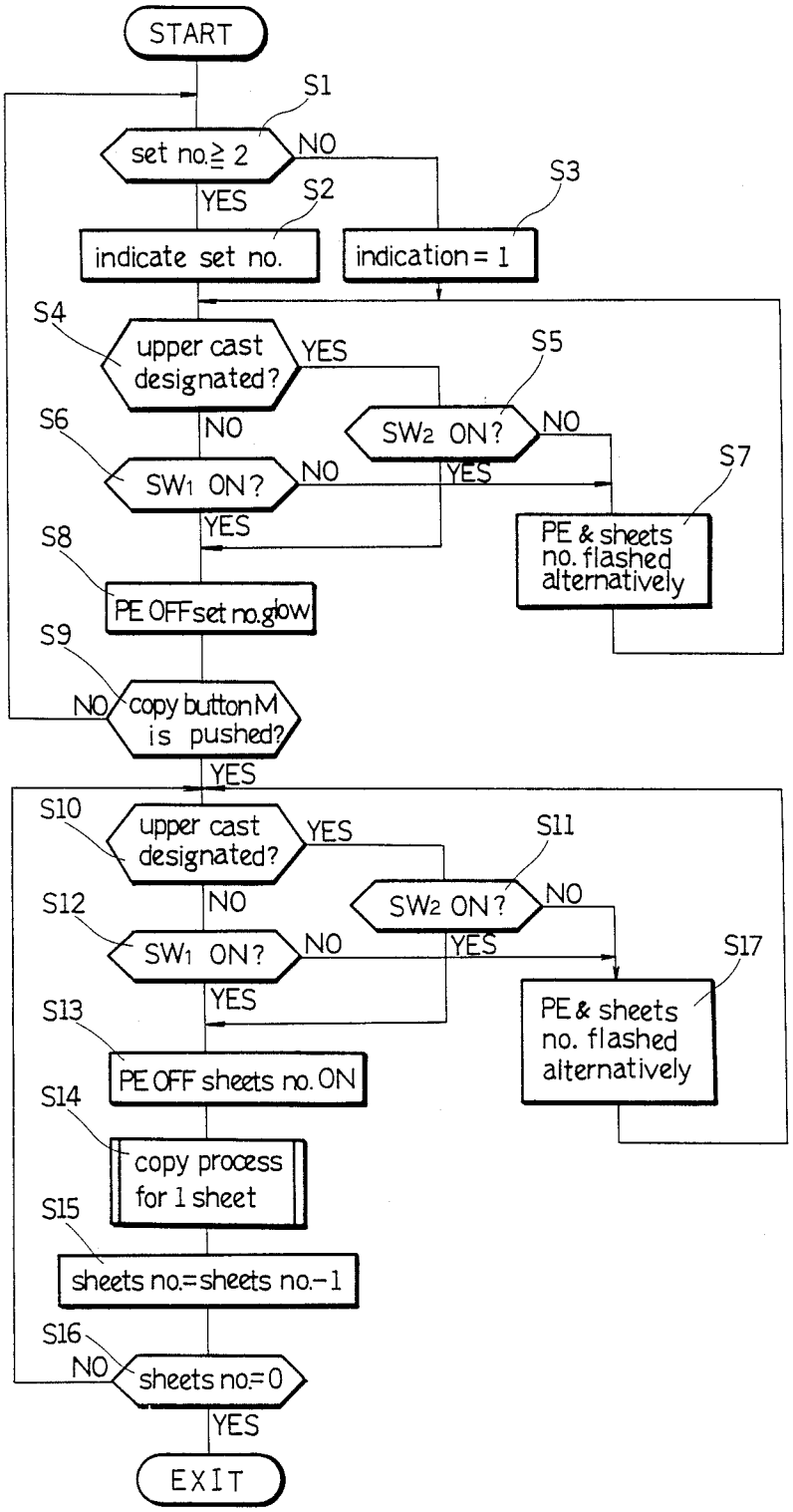
FIG. 2 is a flowchart showing the information processing procedure of the same display.

Now appears the description of the procedure of indication processing using each one of the above elements with referring to FIG. 2.

In the description of the following flowchart, S1, S2 . . . indicate the number of each processing procedure (step).

When power is closed first, it is judged by S1 whether or not any number of sheets to be copied is set. The number of sheets to be copied can be set on the display J up to 99 sheets maximum by pushing the button switch K1 for setting the tenth digit and the button switch K2 for setting the unit digit, as described above.

However, value 1 is set on the display J at the time of power making or when the clear key i.e. the push-button L is pressed.

If 2 or larger value is set at step S1 as the preset number of sheet, the processing advances to step S2. If value 1 on the display is kept as it is, the processing advances to step S3.

When 2 or larger value is set, the set number is indicated on the display J at step S2. At step S3, operation proceeds to step S4 while keeping the value on the display J at value 1.

At step S4, it is judged whether or not the upper stage cassette 2*b* is designated as the paper feeding mechanism and if the upper stage cassette 2*b* is designated, the processing proceeds to step S5. If the lower stage cassette 2*a* is designated, it is judged at step S6 whether or not the copy paper sensing switch SW1 of the lower stage is turned to ON.

If the copy paper sensing switch SW1 is not turned to ON at step S6 even though the lower stage cassette 2*a* is designated at step S4, it means that no copy paper is in the designated lower stage cassette 2*a*, and the processing proceeds to step S7, the indication of PE and the indication of the number of sheets which has been indicated on the display J (in this case, the preset number of sheets or indication 1 displayed at step S3) are flashed alternatively, then the processing returns to step S4, and the closed loop of S4, S6 and S7 is repeated. In this case, the indication of PE means that there is no copy paper on the designated paper supplying mechanism. If the copy paper sensing switch SW2 at the side of cassette 2*b* is not ON state, despite the judgement at step S4 that the upper stage cassette 2*b* is designated, i.e. if negative judgement is made at step S5, the indication of PE and the indication of number of sheets are repeated alternatively at step S7 like in the case of negative judgement at the above mentioned step S6.

Thus the operator notes that the cause of machine stop is no copy paper in the cassette and can judge how many sheets of copy paper are required to complete the copying operation at a time. If the copy paper sensing switch SW2 or SW1 of the designated cassette is turned to ON at step S5 or S6, i.e. when the designated cassette is judged to have copy paper, or when copy paper is supplied to the designated cassette by the operator, PE indication of no copy paper is put OFF, and the above preset number of sheets as the indicated number or indication of value 1 glows (S8).

In the following step S9, it is judged whether or not the copy button M is pushed. If the copy button M is not pushed, the processing from step S1 to step S8 is repeated. If the copy button M is pressed, the processing advances to step S10, and it is judged, like in the case of step S4 to S6, whether or not the upper stage cassette 2*b* is designated, and whether or not the copy paper sensing switch at the side of the designated cassette, SW1 or SW2 is turned to ON. (S11, S12)

If, in this case, the copy paper sensing switch SW2 or SW1 at the side of the designated cassette is turned to ON at step S11 or S12, the processing advances to step S13, PE indication is turned to OFF, and the state of indicating the value of the number of sheets to be copied is continued.

In this case, the value of the number of sheets to be copied is equal to the number of preset sheets less the number of copied sheets. As no copying process has been made yet in this case, the preset number of sheets set at step S2 or value 1 indicated at step S3 is displayed as the number of sheets to be copied.

In step S14, a series of sub-routine for copying process of one sheet is executed. When copying process of one sheet completes, 1 is deducted from the number of sheets to be copied which is indicated on the display J (S15), and in step S16, it is judged whether or not the remaining number of sheets to be copied is decreased to zero, and if not decreased to zero yet, the processing returns to step S10.

So long as any copy paper is kept in the designated cassette, processing from step S10 to S16 is repeated until copying process of the preset number of sheets completes.

When the copy paper P in the designated cassette is used up during above copying operation, negative judgement is made at step S11 or S12, and processing skips to S17 without going to S13. At this step, the indication of PE and the indicatioin of the number of sheets to be copied are given alternatively, like in the case of step S7, to provide the operator with both information that no copy paper is in the cassette and how many sheets of copy paper must be supplied, then the processing returns to step S10.

The processing, therefore, repeats the loop from S10 to S17 going through S11 or S12 unless the operator notes the indication and supplies copy paper to the designated cassette.

In this embodiment, the indication of PE and the number of sheets to be copied are given alternatively, but it is also possible to alternatively indicate PE and the number of sheet already copied, or to indicate the preset number of sheets to be copied in addition to the remaining number of sheets to be copied, or the nubmer of sheets already copied and PE indication.

In the above embodiment, the paper supplying mechanism is provided with the copy paper sensing switches SW1 and SW2, and indication of disabled paper feeding and of preset number of sheet to be copied (number of processing sheets) are given alternatively according to the information of no copy paper obtained by the signals from these switches.

The effect is significant in that the operator can know directly when PE indication is given that the cause of machine stop is not paper jam or others and that operation can be started again simply by supplying copy paper.

Figure 5:
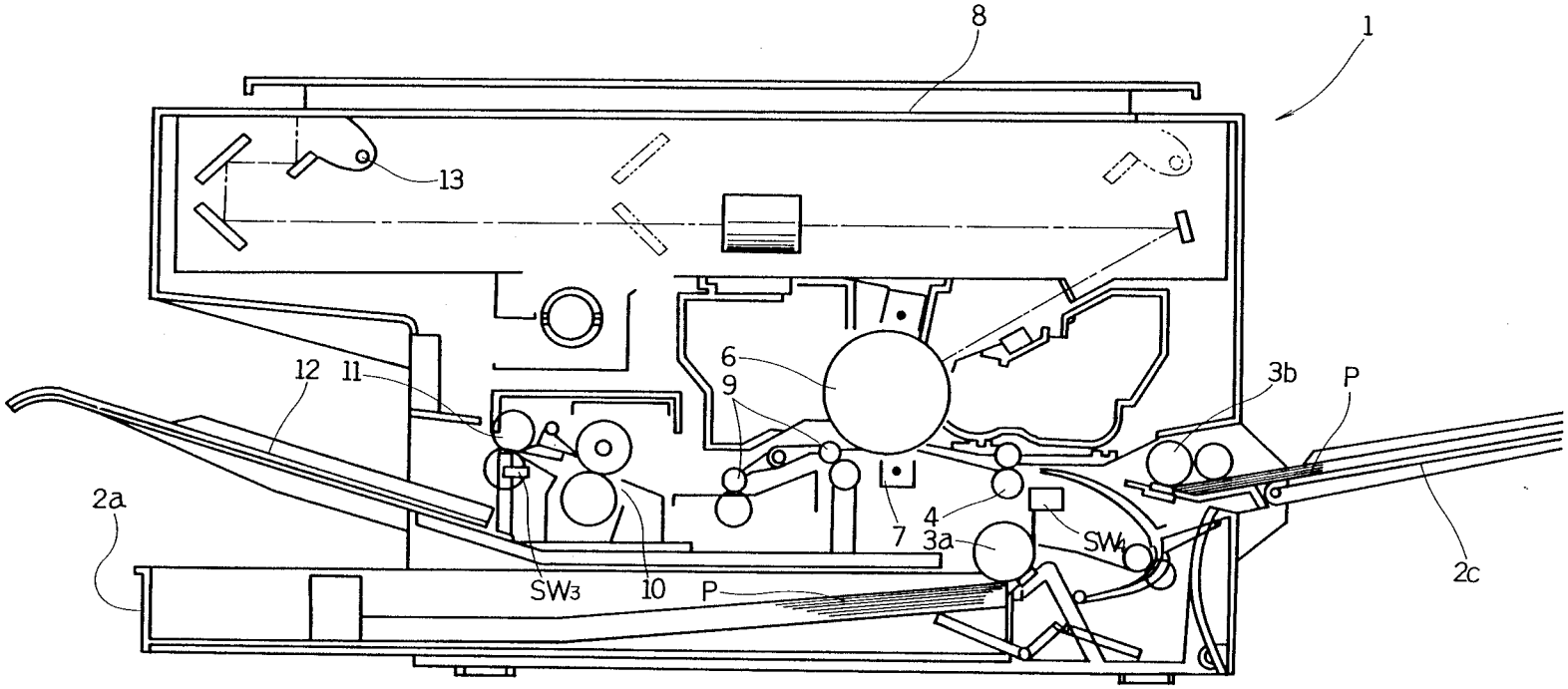
FIG. 5 is a schematic structural drawing of an example of a copying machine provided with the same display.

In the following embodiment, even the copy paper sensing switches of the paper supplying mechanism are eliminated for cost reduction. The copying machine shown in FIG. 5 as the background of this embodiment is simplified more than the one shown in FIG. 3. For example, only one cassette (2*a* ) is provided, and the copy paper sensing switches SW1 and SW2 are omitted.

And LED F2 shows paper supply from the manual paper supplying mechanism 2C. As for other components common to those of the apparatus shown in FIG. 3, further description is omitted here because the same symbols are used. Following now is the description of the procedure of indication by using each one of the above components and by referring to FIG. 4.

In the description of the following flowchart, N1, N2 . . . indicate the number of each processing procedure (step). The description is for the case where paper is supplied from the cassette 2*a*.

When power is closed, it is judged at step N1 whether or not the copy button M is pressed. If the copy button M is pressed, the remaining number of sheets to be copied is indicated on the display J, and the main motor 17 is drived. (N2). In this case, the remaining number of sheets to be copied is equal to the preset number of sheets to be copied if no copying process has been made yet. If any number of sheets has already been copied, it is equal to the preset number of sheets less the number of sheets already copied.

At the following step N3, the paper feed clutch 18*a* is turned to ON, and copy paper supply from the cassette 2*a* starts. At the next step N4, it is judged whether or not the paper feed sensing switch SW4 is turned to ON. If not turned to ON, it is judged at step N5 whether or not (t) seconds have elapsed after the paper feed clutch 18*a* was turned to ON at step N3. If (t) seconds have not elapsed yet, the processing returns to N4, and the closed loop of N4 and N5 is repeated. If it is judged at step N5 that (t) seconds have elapsed, i.e. if the paper feed sensing switch SW4 is not turned to ON even though (t) seconds have elapsed after the paper feed clutch 18*a* was turned to ON, it is conceivable that there is no copy paper in the cassette 2*a*, or so called paper jam due to, for example, misfeeding of paper occurred by slipping of the copy paper P between the cassette 2*a* and the resist roller 4 is resulted. Accordingly, the condition of disabled feeding of copy paper is displayed. For example, indication of trouble such as PF and of the remaining number of sheets to be copied (number of processing sheets) which has been indicated on the display J are turned to ON alternatively. (N6)

By the indication, the operator can confirm that the machine is stopped due to a trouble in the paper feeding pass up to the resist roller 4, and can check the remaining number of sheets to be copied at the moment. If no copy paper is in the cassette 2*a*, the operator supplies the required number of sheets of copy paper, and can also supply copy paper to the cassette or to the manual paper supplying tray while handling the jammed paper, which serves to improve efficiency of copying operation.

As soon as the alternative indication of trouble indication PF and of the remaining number of sheets to be copied is given at step N6 as described above, the main motor 17 is stopped at step N7 and the paper feed clutch 18*a* is also turned to OFF to prevent the trouble from being expanded, and the processing is returned to step N1.

If paper is supplied from the manual paper supplying mechanism 2C, the paper feed clutch 18*b* is turned to OFF.

If the paper feed sensing switch SW4 is judged to be turned to ON at the above mentioned step N4, i.e. if the paper feed sensing switch SW4 is turned to ON within (t) seconds after the paper feed clutch 18*a* was turned to ON, it can be taken that copy paper has been supplied to the resist roller 4 within the specified time of (t) seconds. Therefore, no jamming of paper is confirmed, and the paper feed clutch 18*a* is turned to OFF in the following step N8, and the sub-routine of copying shown in step N9 is executed.

The copy processing at step N9 is for one sheet only, and 1 is deducted from the number of remaining sheets to be copied in the next step N10, and the remaining number of sheets to be copied after the deduction is indicated on the display J.

At step N11, it is judged whether or not the above mentioned number of sheets to be copied is zero, and if the number is not zero, i.e. if it is judged that copy processing must be carried out, the processing is returned to step N3, the next copy paper is taken out from the cassette 2*a*, and the processing from N3 to N11 is repeated to continue copying process. If the remaining number of sheets to be copied is reduced to zero at step N11, i.e. when the copying process of the preset number of sheets to be copied has been completed, the main motor 20 is stopped at step N12 to complete the copying process.

The above description is for the case where a trouble (paper jam, paper misfeeding etc.) happens in the feeding pass up to the resist roller 4, and paper jam concentrates in the above paper supplying mechanism, and in the paper discharge mechanism near the paper discharge roller 11.

Figure 4:
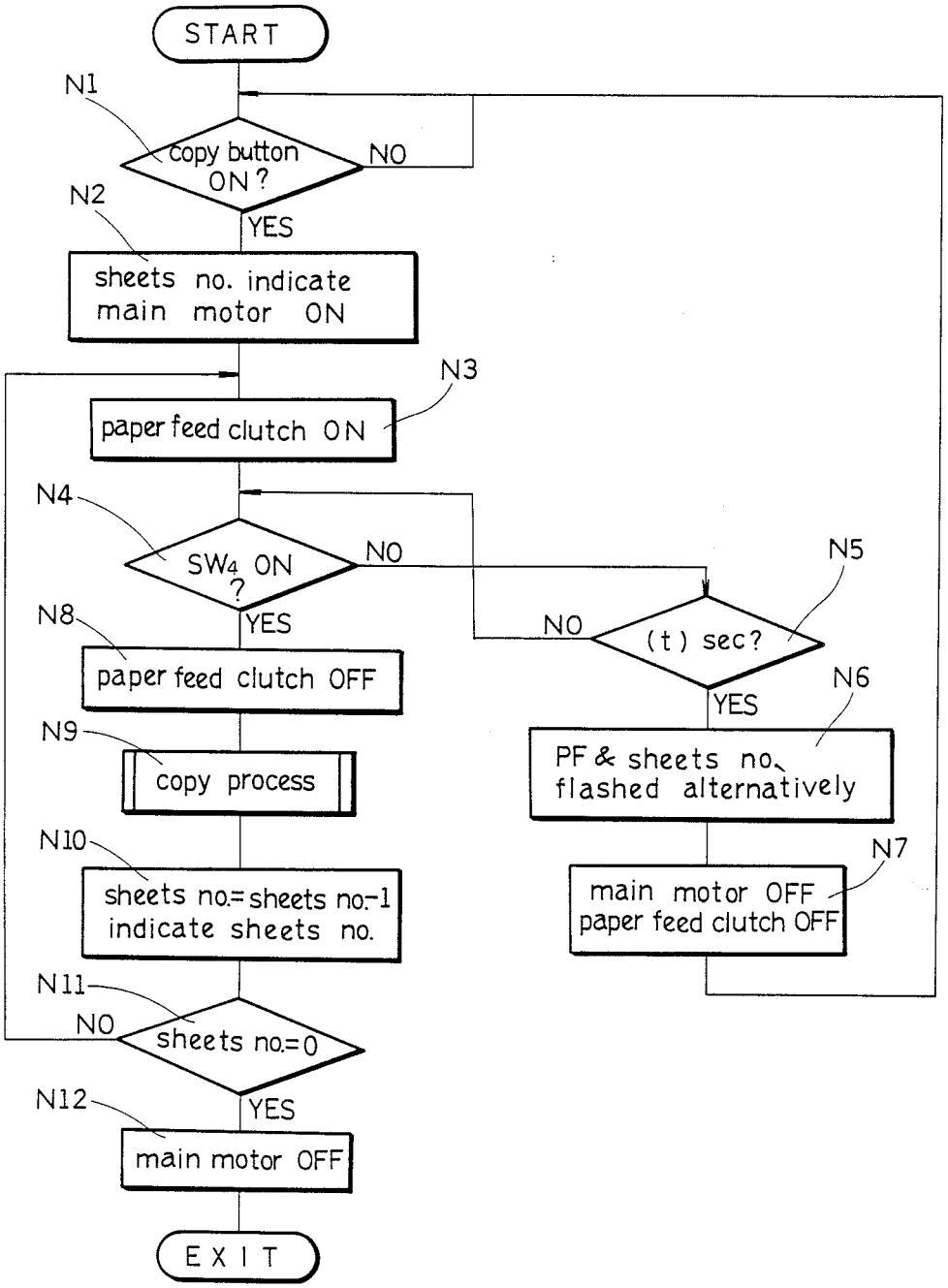
FIG. 4 is a flowchart showing the inforamtion processing procedure of the display of a copying machine of another embodiment.

The jam sensing switch SW3 before the paper discharge roller 11 is for sensing above mentioned paper jam, and the flowchart of FIG. 4 can be substituted for the procedure of trouble indication for the discharge mechanism by changing the judgement at step N4 in FIG. 4 to ON-OFF judgement of the above jam sensing switch SW3. In this case, however, it is desirable to replace the items concerning operation of the paper feeding clutch at step N3, N5, and N8 to the items concerning operation of the resist roller.

It may also possible to glow the trouble indication PF and the number of sheets indication on the above display J when either one of the trouble happen by parallel operation of the flowchart of FIG. 4 concerning trouble indication of the paper feeding mechanism and of the flowchart concerning trouble indication of the above mentioned paper discharge mechanism.

In this embodiment, the indication of PF and of remaining number of sheets to be copied flashed alternatively. It may also possible to replace the remaining number of sheets to be copied with the number of copied sheets, and also to alternatively display the preset number of sheets to be copied in addition to the indication of remaining number of sheets to be copied or the number of copied sheets and PF indication.

Though not shown in the flowchart, alternative display of PF and number of sheets to be copied can be reset by pushing the copy button M again to the mode of individual indication of remaining number of sheets to be copied, number of sheets already copied, and preset number of sheets to be copied.

While only certain embodiments of the present invention have been described, it will be apparent to those skilled in the art that various changes and modifications therein may be made without departing from the spirit and scope of the present invention as claimed.

What is claimed is:

1. A display for image processing apparatus so composed as to indicate number of processing sheets and disabled paper feeding on the paper supplying mechanism on one display separately by time-sharing in which said indication of disabled paper feeding and said indication of number of processing sheets are given alternatively while said indication of disabled paper feed is made.

2. A display in accordance with claim 1 in which said indication on disabled paper feed is made according to the signal from a paper sensing switch provided in said paper supplying mechanism.

3. A display as defined by claim 1, wherein said indication of disabled paper feed is attributable to paper jam.

* * * * *